US006823820B2

(12) United States Patent
Thoma

(10) Patent No.: US 6,823,820 B2
(45) Date of Patent: Nov. 30, 2004

(54) APPARATUS FOR HEATING FLUIDS

(76) Inventor: Christian Helmut Thoma, Chalet Abaco, Green Road, St. Clement, Jersey (GB), JE2 6OA ( * ) Notice: Subject to any disclaimer, the term of this patent is extended or adjusted under 35 U.S.C. 154(b) by 93 days.

(21) Appl. No.: 10/308,027

(22) Filed: Dec. 3, 2002

(65) Prior Publication Data

US 2004/0103855 A1 Jun. 3, 2004

(51) Int. Cl.[7] ..... F22B 3/06
(52) U.S. Cl. ..... 122/26; 126/247; 237/12.3 R
(58) Field of Search ..... 122/26; 126/247; 237/12.3

(56) References Cited

U.S. PATENT DOCUMENTS

| | | | | |
|---|---|---|---|---|
| 2,090,873 A | * | 8/1937 | Lazarus | 126/247 |
| 3,791,349 A | | 2/1974 | Schaefer | |
| 4,424,797 A | | 1/1984 | Perkins | |
| 5,188,090 A | | 2/1993 | Griggs | |
| 5,392,737 A | * | 2/1995 | Newman et al. | 122/26 |
| 5,913,306 A | | 6/1999 | Moroi et al. | |
| 6,129,287 A | * | 10/2000 | Hirose et al. | 237/12.3 R |
| 6,386,751 B1 | | 5/2002 | Wootan et al. | |

FOREIGN PATENT DOCUMENTS

| | | |
|---|---|---|
| DE | 3327137 | 2/1984 |
| DE | 198 17 483 | 10/1998 |
| GB | 1 217 959 | 1/1971 |
| GB | 2 143 632 | 2/1985 |
| WO | WO99/11478 | 3/1999 |

* cited by examiner

*Primary Examiner*—Gregory A. Wilson
(74) *Attorney, Agent, or Firm*—Young & Thompson

(57) ABSTRACT

The apparatus has a housing with a main chamber in which a rotor is situated. The drive shaft drives the rotor about a longitudinal axis of rotation. The housing has a fluid inlet and a fluid outlet, the fluid inlet communicating with an inlet region and a fluid outlet communicating with an exit region. The outer surface of the rotor forms one boundary for the fluid heat generating region chamber which is confronted by the inner surface of the main chamber which is the other boundary. At least one of these surfaces is angularly inclined relative to the axis of rotation of the drive shaft and rotor. By bodily shifting the rotor in a direction along the longitudinal axis, an increase or decrease in the distance between the outer and inner surfaces is possible in order to adjust for wear or to change the degree of shear experienced by the passing fluid.

42 Claims, 9 Drawing Sheets

APPARATUS FOR HEATING FLUIDS

BACKGROUND OF THE INVENTION

This invention relates generally to the heating of liquids, and specifically to those devices wherein rotating elements are employed to generate heat in the liquid passing through them. Devices of this type can be usefully employed in applications requiring a hot water supply, for instance in the home, or by incorporation within a heating system adapted to heat air in a building residence. Furthermore, a cheap portable steam generation could be useful for domestic applications such as the removal of winter salt from the underside of vehicles, or the cleaning of fungal coated paving stones in place of the more erosive method by high-pressure water jet.

Joule, a wealthy Manchester brewer and English physicist who lived during the $19^{th}$ century, was the first experimenter to show that heat could be produced through mechanical work by churning liquids such as water. Joule's ideas, as well as the work of others such as Lord Kelvin and Mayer of Germany, eventually led to the Principle of the Conservation of Energy. On the basis of this law, that energy can neither be created nor destroyed, numerous machines have been devised since Joule's early work. Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates past the annular clearance existing between the rotor and the housing to exit the housing at the opposite end. The fluid is arranged to navigate this annular clearance between the static and non-static fluid boundary guiding surfaces, and Perkins relies principally on the shearing effect in the liquid, causing it to heat up.

A modern day successor to Perkins is shown in U.S. Pat. No. 5,188,090. Like Perkins, the James Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different effect than the forementioned fluid shearing of the Perkins machine, and which Griggs calls hydrodynamically induced cavitation.

What is certain is that both Perkins and Griggs choose to employ a fixed gap clearance between the rotating rotor and the static housing. The choice thus made means that once the machine is assembled, the clearance cannot be changed. Although changing the clearance can obviously be achieved, through subsequent machine disassembly and substitution of the rotor with one having either a smaller or larger diameter, such an act is both costly and time consuming to perform. Also, once such a machine is installed in its intended application environment, it may turn out not to be best suited for the task at hand, and any subsequent rectification at the site of the application is best avoided if at all possible. An expensive option would be to manufacture a series of machines, each exhibiting a slight variation in the clearance size. However, a better and more advantageous solution would be include the possibility for changing the clearance without having to disassembly the machine. This could also be easily done at the site of the application.

A further problem could occur in the event of any appreciable wear occurring during the design lifetime of the machine. Scale or other impurities that may on occasion pass through the clearance might cause sufficient damage to the surfaces that as a result, there is a noticeable drop in the efficiency of energy conversion. Were this to occur with such fixed clearance devices, the machine would require disassembly and repair. There would be an advantage however, if the damaged surfaces could be readjusted to reduce the operating clearance, thus saving the expense of performing a costly repair.

There therefore is a need for a new solution to overcome the above mentioned disadvantages, and in particular, there would be an advantage if the solution were simple to implement, resulting in an improved and more easily controllable device, and especially whenever possible, without the need for the device to be torn down from the application in order to perform the required alterations/corrections in the event, for instance, a change in the desired operational characteristics of the device be sought for.

SUMMARY OF THE INVENTION

A principal object of the present invention is to provide a novel hot water and steam generator capable of producing heat at a high yield with reference to the energy input.

Its is a further object of the invention to use a vector component of the centrifugally induced forces in the liquid towards propelling the liquid through the device, in addition to the impulse on the fluid introduced by the difference in relative velocities of the opposing fluid boundary surfaces. It is therefore a feature of the invention that liquid particles drawn into the annular conduit are not only heated through the shearing action between the opposing fluid boundary surfaces, but are also propelled by such natural forces known in nature to exit the device.

It is a further feature of this invention, as disclosed for certain preferred embodiments, that there be an ability provided whereby the size of clearance between the rotating and stationary elements can be changed without undue complication. Changing the clearance, squeezing the fluid film in the gap between the static and non-static fluid boundary guiding surfaces, introduces a change in the dynamic behaviour of the fluid as it rushes over these surfaces.

There would also be an advantage in being able to take care of a small amount of wear affecting the working clearance of the device, simply and cheaply, by resetting the minimum amount of gap height in the clearance. It is therefore a further object of the invention to provide, when required, provision for the adjustment in the annular clearance between rotor and housing. Furthermore, such an adjustment will allow each machine to be fined tuned and tailor made to suit each particular application.

It is a further aspect of this invention to provide an internal fluid heating vessel chamber for the device in which the radial width dimension changes as soon as the axial length dimension is changed. Therefore, in one form of the invention as described, the annular fluid volume between the rotating rotor and the static housing is changed as soon as the rotor is displaced along its longitudinal rotating axis. By thus altering the annular fluid volume, the shear in the passing fluid is changed. Turbulence and frictional effects experienced in the fluid during its passage through the annular fluid volume can thereby be more easily controlled as compared to prior solutions relying on a fixed clearance between the revolving rotor and the static housing. Accordingly, it is a further object of the invention for the device to provide more flexibility for each particular application and dynamic operational condition, regardless whether the heat output is in the form of a liquid or vapour at various pressures.

In one form thereof, the invention is embodied as an apparatus for the heating of a liquid such as water, comprising a housing having a main chamber. A central member is located in the chamber and moveable relative to the housing about an axis of rotation. The central member is provided with an outer surface and the chamber is provided with an inner surface radially spaced apart such that these surfaces confront each other without touching so thereby defining an annular fluid volume between them. A fluid inlet is arranged to communicate with the annular fluid volume nearer one end of the chamber and where a fluid outlet is arranged to communicate with the annular fluid volume nearer the opposite end of the chamber. At least one of these surfaces is to be angularly inclined with respect to the axis of rotation.

Any relative axial movement between these surfaces will result in a change in the annular fluid volume, expanding or contracting, and where preferably, the central member is a rotor having its smaller diametric end nearer the fluid inlet and the larger diametric end nearer the fluid outlet.

According to the invention from another aspect, the smaller diametric end of the rotor can be formed to include an impeller. The action of the rotating impeller on the fluid entering the chamber being to propel it outwardly and where the axial position of the impeller moves along the longitudinal axis of the drive shaft in accordance with the bodily shifting of the rotor assembly. It is therefore a still further aspect of this invention, as disclosed for certain preferred embodiments, to provide a device of the preceding objects in which the intake of fluid from an external source is excited by an internally driven spinner impeller to substantially raise the pressure of fluid entering the annular fluid volume also termed the fluid heat generating region. By thus increasing the positive head on the fluid as it commences entry to the fluid heat generating region, the running efficiency of the device may thereby be improved.

Applications where mains water pressure can be used, or the source tank is situated well above the height of the device thereby providing a positive head at the fluid inlet, the impeller may be omitted. However, under normal atmospheric conditions with liquid entering the device from a source having a surface level positioned approximately at the same height elevation as the device, the addition of an impeller would better ensure positive priming of the device. In the preferred embodiments used to describe the present invention, such an impeller is shown.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATED EMBODIMENT OF THE INVENTION

Figure 1:
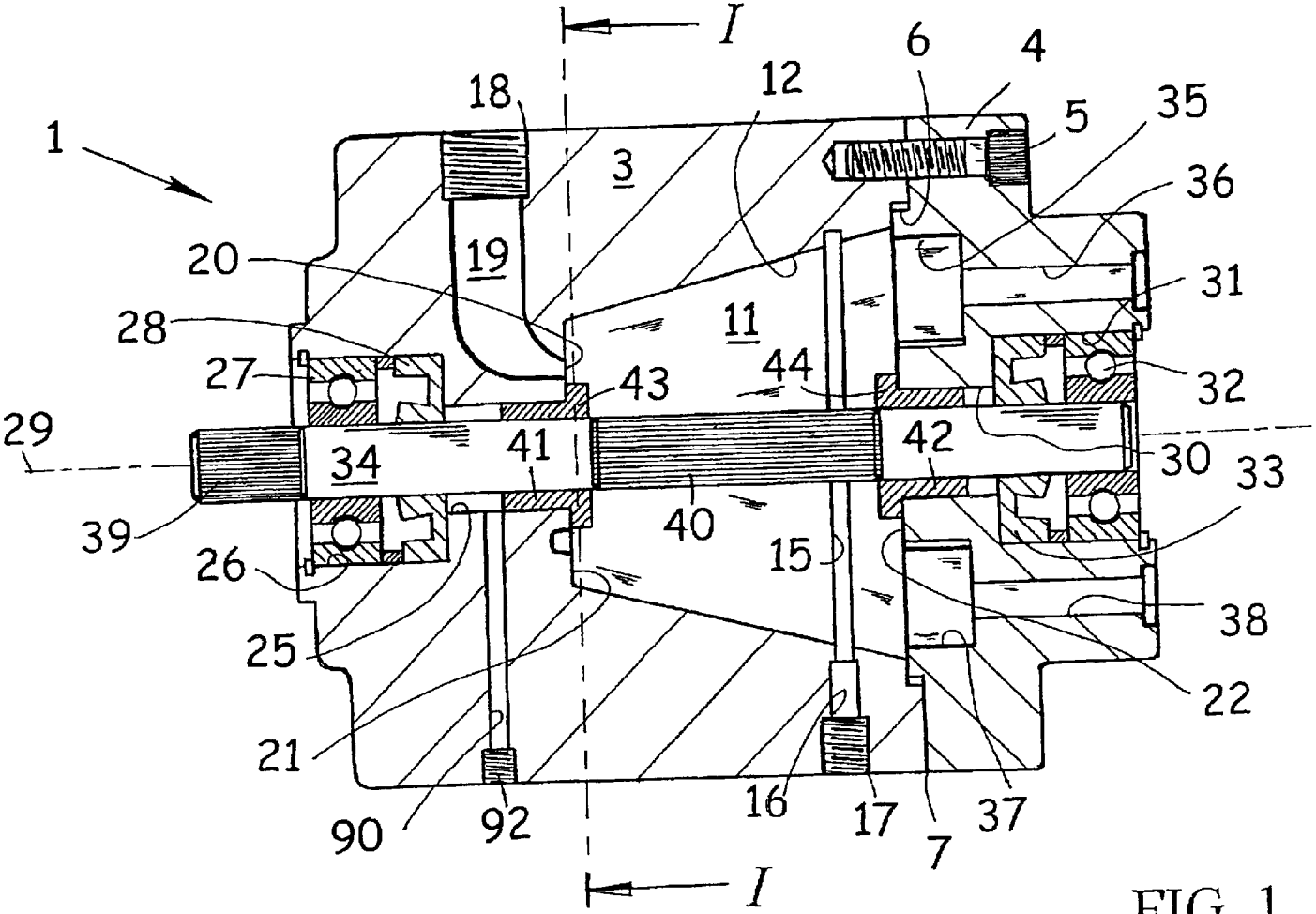
FIG. 1 is a longitudinal sectional view of a device in according to the first embodiment of the present invention, with the rotor assembly missing.

Referring to FIG. 1, the device as designated by reference numeral 1 has a housing structure comprising two elements 3, 4 joined together along a parting plane denoted by numeral 7. A number of fastening screws 5 is used to hold housing elements 3, 4 together and alignment is achieved through radial register 6. To simplify description of the device, it will be noted by comparing FIG. 1 with FIGS. 3 and 4, that the central member, it being the rotor assembly 10, has purposely omitted from FIG. 1 but is shown in its extreme right and left hand positions in FIGS. 3 and 4, respectively.

As the device 1 relies on having a rotor assembly to function, FIG. 1 is purely intending to portray the shape of main chamber depicted by numeral 11 in FIG. 1. Housing element 3 is provided with a conical inner surface 12 having its greater diameter nearer the registered end 6 and the smaller diameter in the interior of housing element 3. Included on the conical inner surface 12 is circumferential liquid capturing groove 15, and groove 15 is connected by radial passageway 16 to the fluid outlet 17 of the device 1. In the example shown, capturing groove and radial passageway (leading to the fluid outlet 17) collectively form the exit region. Fluid outlet 17 allows the exhausted liquid or gas to exit the heating apparatus once it has been heated due the action of the rotating rotor in concert with the stationary housing.

Figure 2:
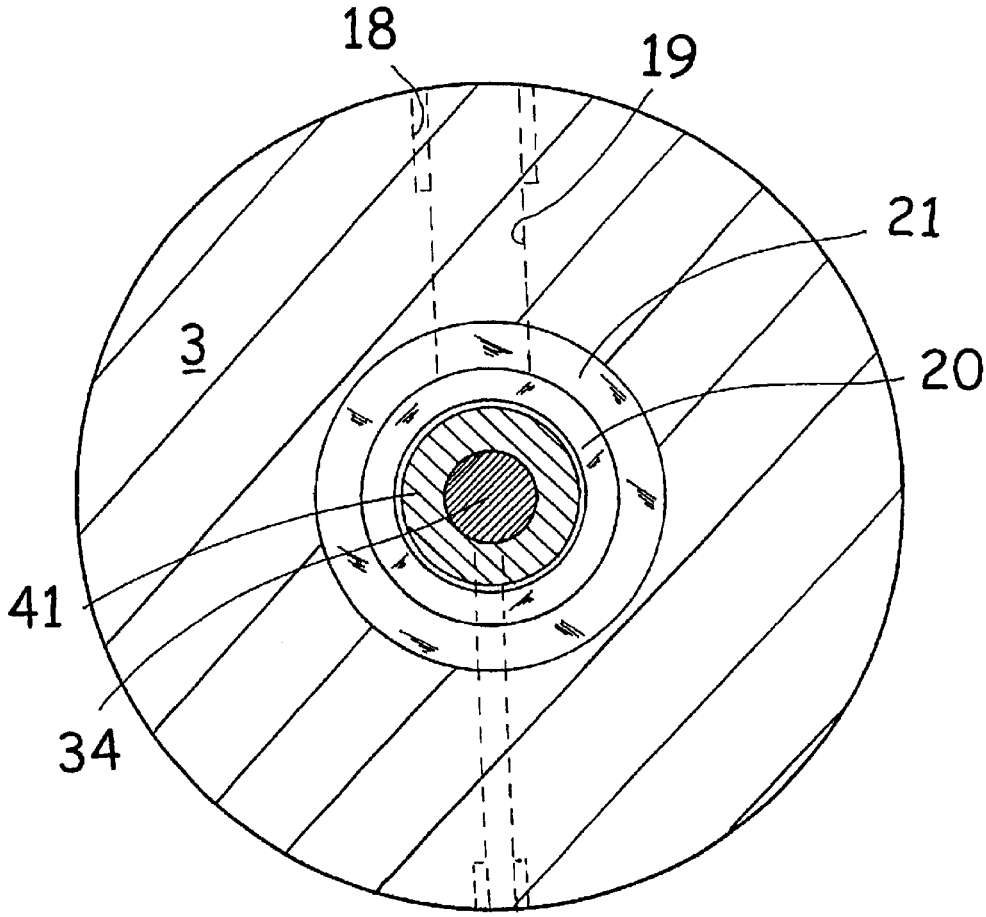
FIG. 2 is a transverse sectional view of the device taken along line I—I in FIG. 1.

Fluid inlet 18, for allowing fluid from an external source to enter the heating apparatus 1, is provided in housing element and where passageway 19 connects fluid inlet 18 with, main chamber 11 via port 20. Port 20 is formed on interior vertical face 21 in housing element 3, and as shown in FIG. 2, port 20 is preferably circular in shape. The portion of main chamber 11 lying between vertical face 21 and left hand end face of the rotor assembly 10, that connects with passageway 19 via port 20 forms the inlet region. At the center of vertical face 21, axial hole 25 is provided and which is stepped at 26 in order to accept bearing 27 and seal 28. A similar sized axial hole 30 is provided in housing element 4, and is likewise stepped at 31 in order to accept bearing 32 and seal 33. Hole 30 is arranged to lie at the center of vertical face 34. The bearings 27, 32 provided support for the drive shaft 34. The drive shaft 34 once located in the housing structure of the device protrudes out from one side of the housing to be connected to an external drive source such as an electric motor. Although by no means essential, it can nevertheless be desirable for the drive shaft to be driven by a constant speed electric motor. The drive shaft 34, rotatably supported in housing element 3 by bearing 27, extends into main chamber 11 and is rotatably supported in housing element 4 by bearing 32. The action of seals 28, 33 protects bearings 27, 32 from the liquid in main chamber 11. The bearings 27, 32 preferably are provided with an integral dust seals on their outboard sides to protect against environmental contamination.

Figure 3:
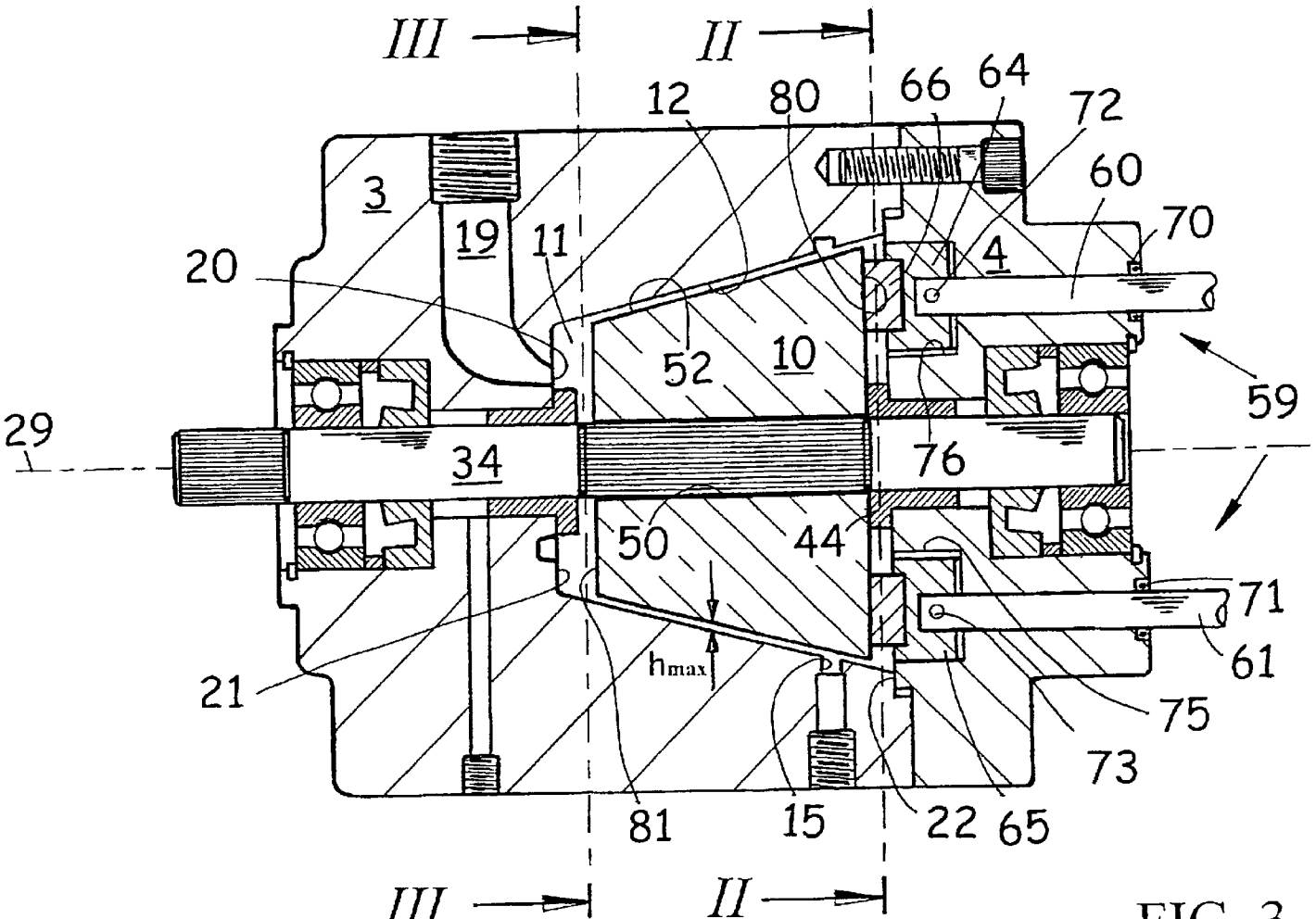
FIG. 3 is a longitudinal sectional view of a device in according to the present invention with the internally disposed rotor assembly shown in the extreme right position corresponding to the maximum annular fluid volume.

Housing element 4 also includes a pair of stepped bores 35, 36 and 37, 38 respectively, as shown in FIG. 1., the respective longitudinal axes of which lies parallel to the rotating axis 29 of the drive shaft 34. In FIG. 3 it is shown how such bores relate with rotor assembly displacer 59.

The externally protruding end 39 of drive shaft 34 is shown formed with drive splines although other forms of drive connections can alternatively be used such as a keyway. Preferably, similar splines 40 are provided along that portion of the drive shaft 34 that spans internal chamber 11. A pair of sleeves 41, 42 are provided to each side of the splines portion 40 of drive shaft 34, sleeve 41 being located in hole 25 in housing element 3 with its flanged end 43 residing slightly proud of vertical face 21. Similarly, the flanged end 44 of sleeve 42 resides slightly proud of vertical face 22 of housing element 4 whereas the remaining portion engages with hole 30.

In FIGS. 3, the rotor assembly 10, being the central member for the device 1, is shown located in main chamber 11. Rotor assembly 10 is provided with a central longitudinal splined hole 50, which engages splines 40 of drive shaft 34. Thereby rotor assembly 10 and drive shaft 34 can rotate at equal speed while the splined connection 40, 50 allows the rotor assembly 10 to be displaced axially along the longitudinal axis of drive shaft 34 to an extent governed by the flanged ends 43, 44 of respective sleeves 41, 42. Essentially flanged end 43 limits the potential axial movement of the rotor assembly 10 in the left hand direction towards vertical face 21 of main chamber 11 whereas flanged end 44 limits the potential axial movement in the right hand direction towards vertical face 22. FIG. 3 shows the rotor assembly 10 in its extreme right hand position, i.e. adjacent to flanged end 44 of sleeve 42.

Figure 4:
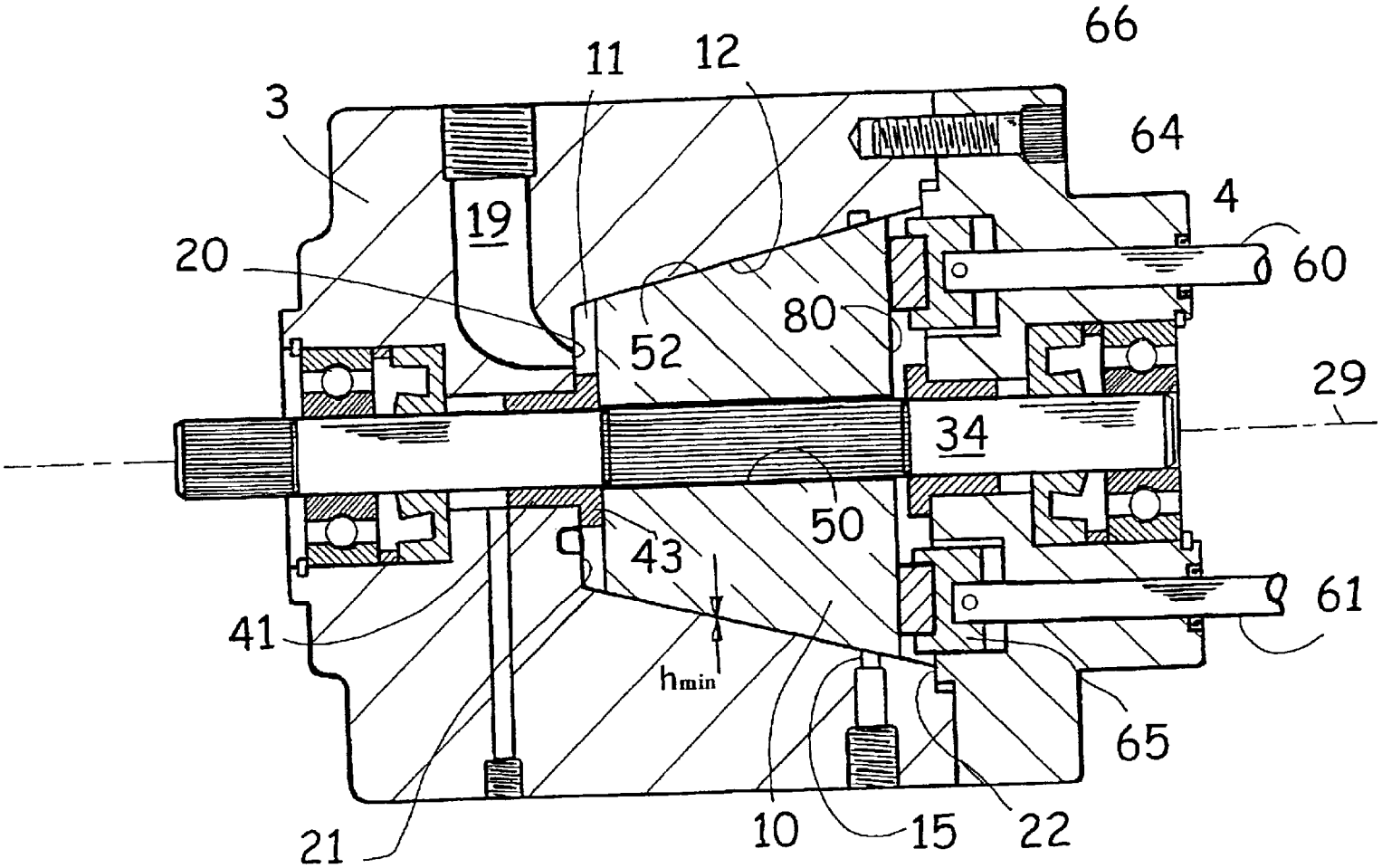
FIG. 4 is a longitudinal sectional view of a device in according to the present invention with the internally disposed rotor assembly shown in the extreme left position corresponding to the minimum value annular fluid volume.

Rotor assembly 10 is provided with a outer surface 52 which is arranged disposed parallel to the inner surface 12 in chamber 11. In this embodiment, both surfaces 12, 52 are angularly inclined with respect to the rotating axis of the rotor by the same amount. As such, the surface 52 on the rotor 10 and the inner surface 12 of the housing 3 face each other with a predetermined radial distance shown as $h_{max}$ in FIG. 3. Thus these first and second surfaces, being circumferentially spaced apart, serve as slightly separated confining walls for directing the passing fluid. The radial distance $h_{max}$ between surfaces 12, 52 is indicative of the maximum annular clearance allowable, annular clearance also being referred to in the claims as the annular fluid volume in the fluid heat generating region, that can occur between the rotating element, namely the rotor assembly 10, and the static element, namely the housing 3. By contrast, FIG. 4 indicates the minimum annular clearance, shown as $h_{min}$, that can occur between these surfaces which although as depicted, the surfaces seem to engage, in practice a very small radial gap would be essential in order to prevent the rotor assembly 10 actually seizing in the housing 3. FIG. 4 therefore shows the rotor assembly in its extreme left hand position, i.e. adjacent to flanged end 43 of sleeve 41, and this being the minimum annular fluid volume condition set for the device 1.

All embodiments of the present invention are shown utilizing the same form of rotor assembly displacer 59, this comprising a pair of rods 60, 61 that act through shoes 64, 65, respectively, and carbon faced seal ring 66 to bodily move rotor assembly 10 in a direction towards vertical wall 21. Should surfaces 12, 52 become worn during service, the facility of the displacer 59 allowing the adjustment of the rotor position relative to the static housing means that there is less chance of such wear being such a problem as in prior machines. Accordingly, with the machine of the present invention, there is now no need to disassemble the machine as now, the radial clearance between the first and second operational surfaces 12, 52 can be reduced by moving rotor 10 axially to be closer to the housing 3.

Although not shown, retraction means can be included, if required, in order to body shift rotor 10 assembly in a direction back towards vertical wall 22. However, as here illustrated, the rotor assembly 10 is biased towards vertical wall 22 by the operational action of the device as well as the agitated state of the liquid during operation on entering main chamber 11 from circular port 20.

Rod 60 is a sliding fit in bore 36 and operates through a seal 70 provided in housing element 4 to engage shoes 64. A cross pin 72 is used to lock rod 60 to shoe 64 and shoe 64 is a sliding fit in bore 35. Similarly, rod 61 is a sliding fit in bore 38 and operates through seal 71 to engage with shoe 65, shoe 65 and rod 61 being retained together by cross pin 73. An axial groove 75 in provided in bore 37 in order to equalize pressure between respective end faces of shoe 65 and a similar axial groove 76 is shown for bore 35.

Figure 5:
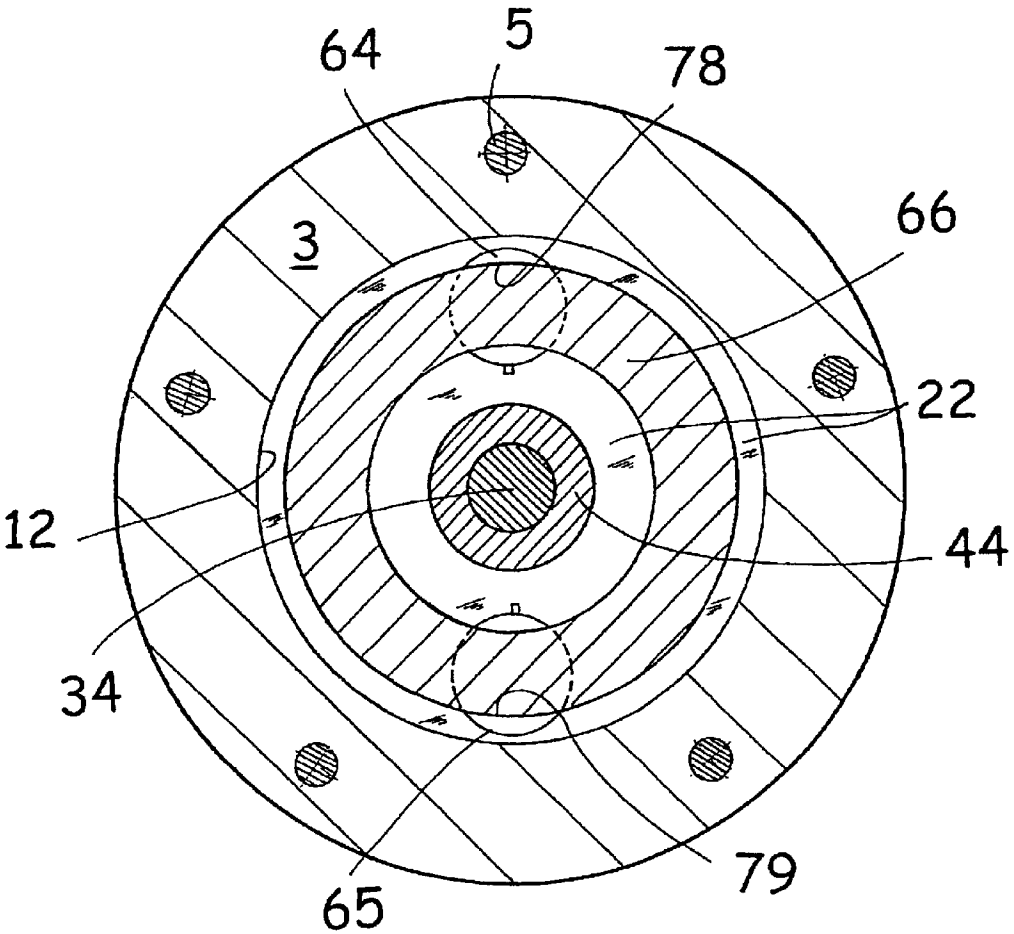
FIG. 5 is a transverse sectional view of the device taken along line II—II in FIG. 3.

Carbon faced seal ring 66 has the shape of a circular disc as shown in FIG. 5 and is arranged to be radially locate in slots 78, 79 in shoes 64, 65 respectively. Carbon faced seal ring 66 operates against the surface face 80 of the larger diameter distal end of rotor assembly 10. Numerals 80, 81 thereby are also indicative of the respective axial ends of the rotor assembly 10.

Figure 6:
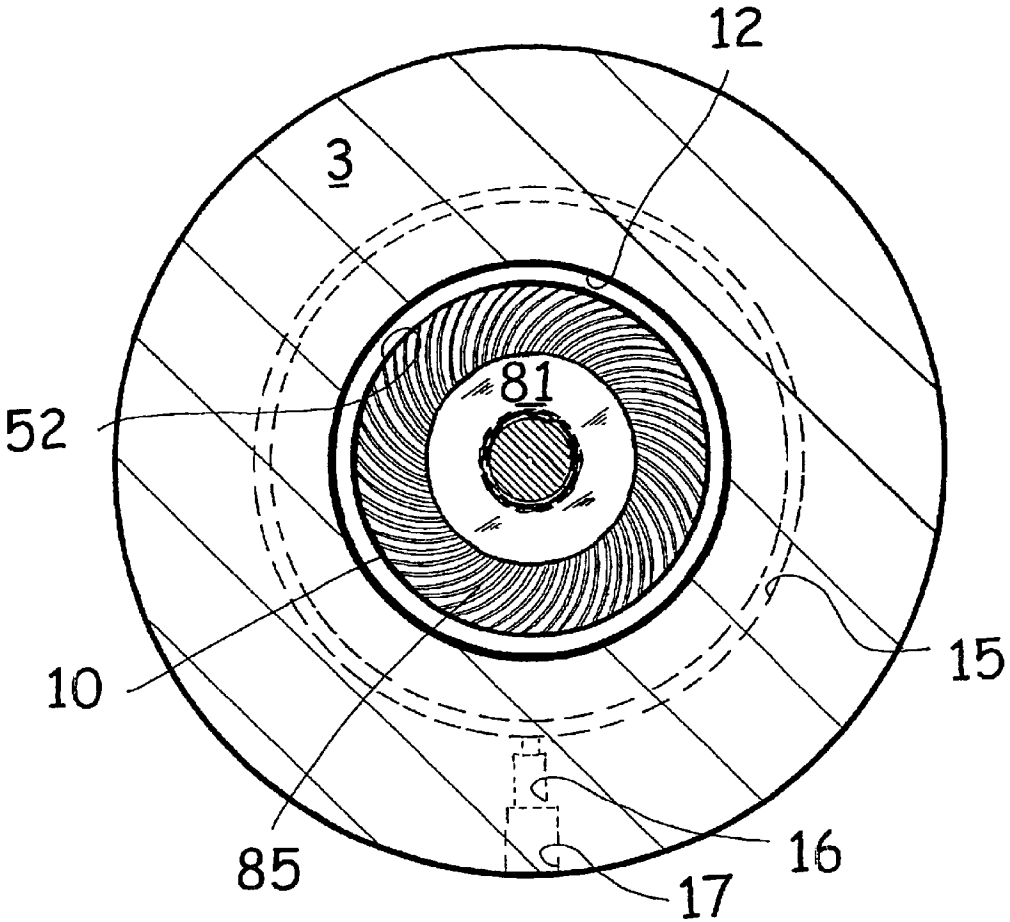
FIG. 6 is a transverse sectional view of the device taken along line III—III in FIG. 3.

The opposing surface on face 81 of rotor assembly 10, as shown in FIG. 6, preferably is formed to include a spinner impeller 85 over a portion of its available end surface, comprising a plurality of curved vanes. Rotating of the rotor assembly 10 in anti-clockwise direction has an immediate effect on the liquid entering through port 20 into inlet region 11 as the curves vanes serve to impel the liquid radially outwardly towards the inner surface 12 of housing element 3.

Though a combination of such agitation caused by the curved vanes as well as any positive head on the liquid as it enters the device 1 at fluid inlet 18, acting together with a suction action on the liquid, generated by the axially expanding annular fluid volume along the length of the rotor assembly 10 between the rotating surface 52 of the rotor assembly and the static surface 12 of the housing element 3, causes the liquid to travels in a direction towards circumferential groove 15. The repeated shearing action on the liquid based on the relative velocity between the stationary and the moving surfaces, as it travels through the annular fluid volume towards circumferential groove 15, heats up the liquid. Unlike known machines using rotating rotors, in the present invention the shearing of the fluid takes place over an ever-increasing volume over the substantive axial length of the rotor. The heated liquid in fluid heat generating region on entering circumferential groove 15 and radial hole 16 of the exit region departs from the device 1 as liquid or vapour at fluid outlet 17.

Liquid not expelled from the device but having reached the space between face 80 and vertical wall 22, is allowed to drain from the unit 1 by seeping past carbon faced seal ring 66 and sleeve 42 to reach shaft 34 from where it can travel along splines 40 and sleeve 41 to reach hole 25 and radial drilling 90 and drain connection 92.

DETAILED DESCRIPTION OF THE SECOND EMBODIMENT OF THE INVENTION

Figure 7:
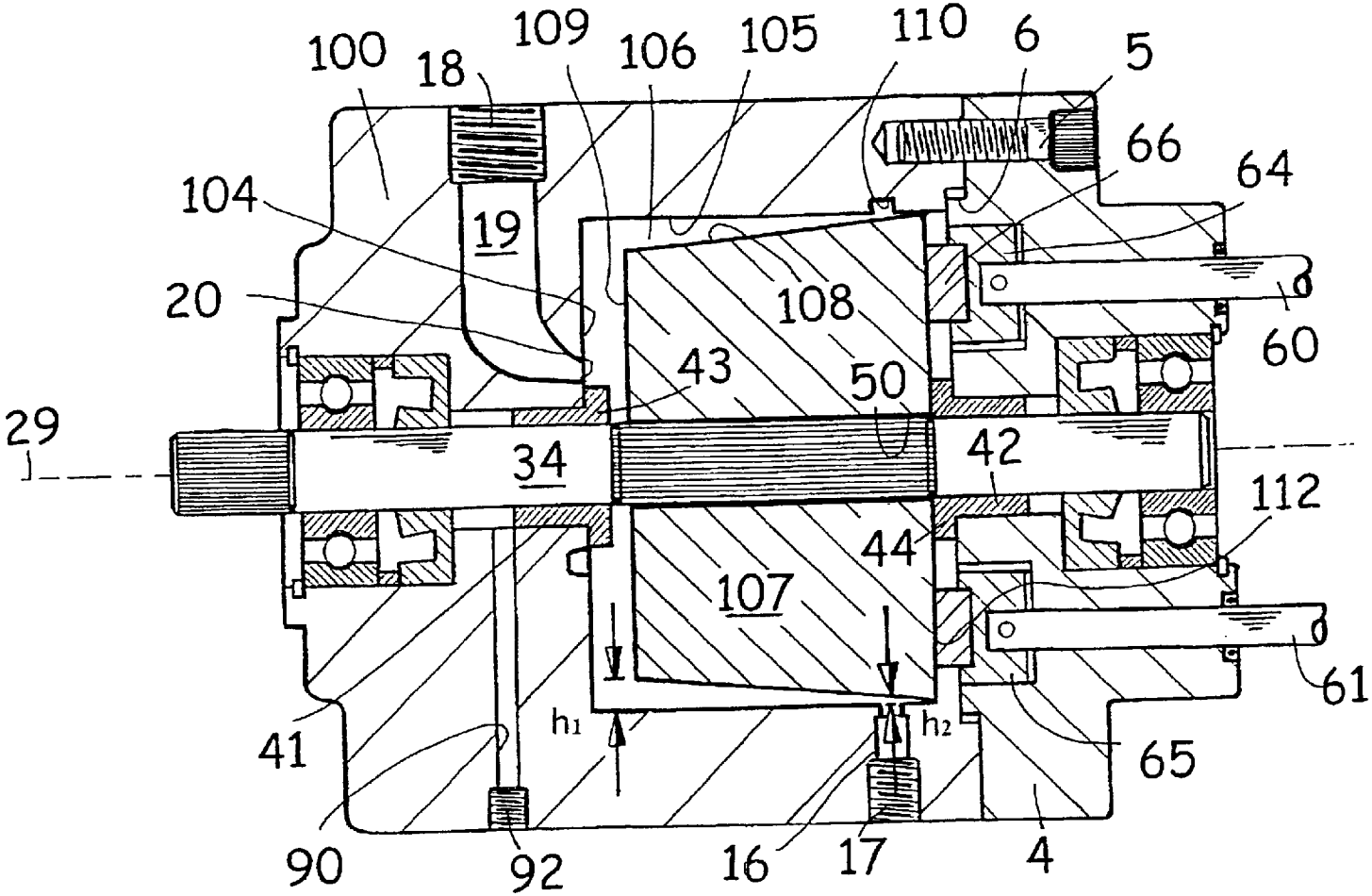
FIG. 7 is a longitudinal sectional view of a device in according to the second embodiment of the present invention, with the internally disposed rotor assembly shown in the extreme right position corresponding to a maximum value for radial clearance at the capturing groove.
Figure 8:
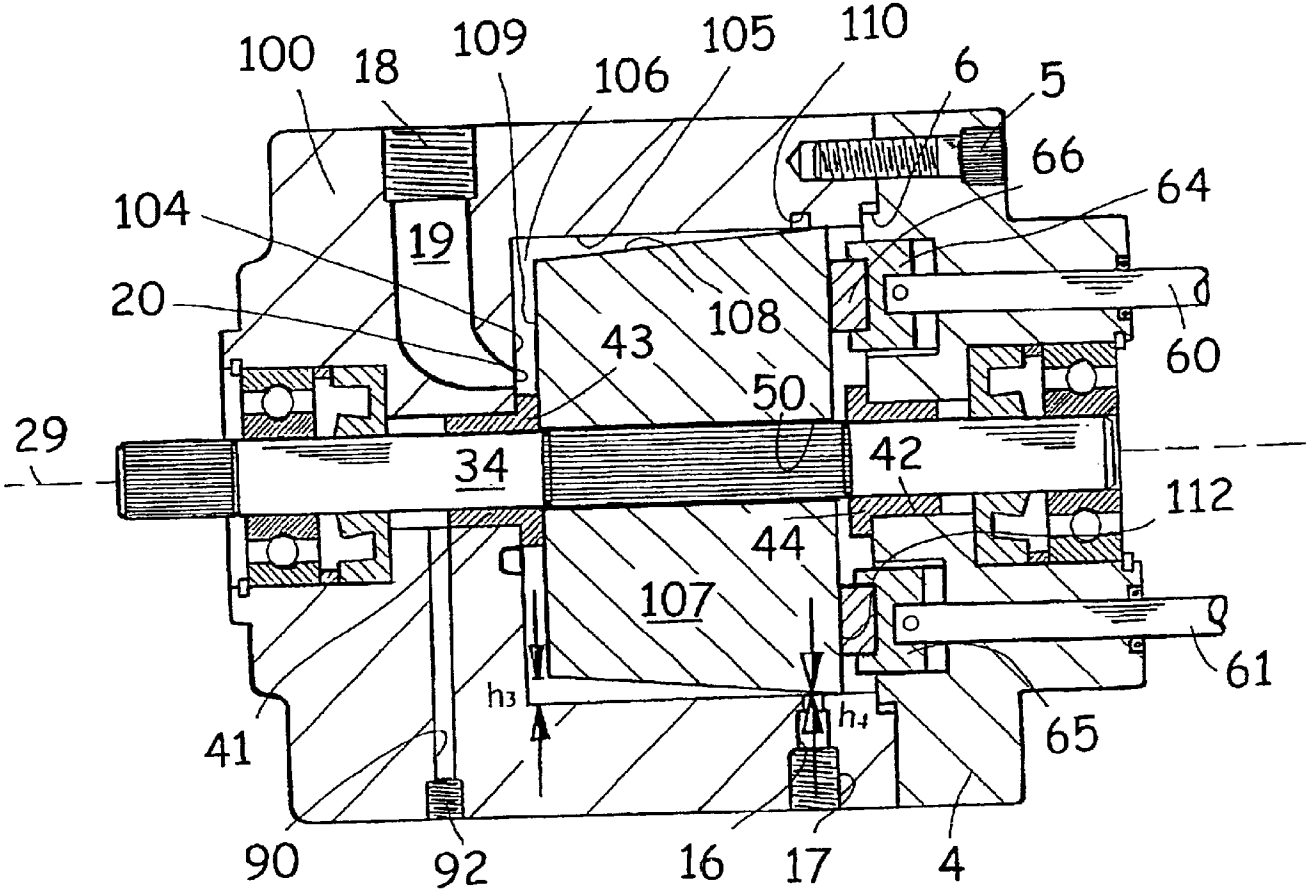
FIG. 8 is a longitudinal sectional view of a device in according to the second embodiment of the present invention, with the internally disposed rotor assembly shown in the left right position corresponding to a minimum value for radial clearance at the capturing groove.

The second embodiment, depicted in FIGS. 7 and 8, differs in two main respects from the above-described first embodiment. Firstly, the inner surface for the main chamber is no-longer conical but parallel, and secondly, the outer surface of the rotor assembly utilizes a less a pronounced tapering angle as compared to that selected for illustrating the first embodiment of the invention. As the other features are all very similar to the earlier embodiment, description is only necessary to show the main points of difference. Further, as many of the components are identical to those described for the first embodiment, for convenience sake, most that are here numbered also carry the same reference numeral as were used for describing the first embodiment.

As shown, housing element 100 is fastened to housing element 4 by a plurality fastening screws 5, the two housing elements 100, 4 being registered together at 6 ensuring the accurate alignment for drive shaft 34. The inner surface 105 in housing element 100 is preferably arranged to be parallel with respect to the longitudinal axis 29 of drive shaft 34, and where 104 is the vertical end wall in housing element 100. The rotor assembly 107 includes a small angular taper on its outer surface 108 in order such that the gap height h1, shown in FIG. 7 for the annular clearance at the smaller diameter end 109 of the rotor assembly 107, remain always greater in magnitude than the gap height h2, shown positioned in FIG. 7 at the center of circumferential groove 110, for the larger diameter end 112 of the rotor assembly 107. The rotor assembly 107 here being positioned to the extreme right hand side to abut against flanged end 44 of sleeve 42. For FIG. 8, the rotor assembly 107 has been displaced towards its other extreme position on the left hand side, to abut flanged end 43 of sleeve 41. In this position it will be apparent that while gap height h3, for the annular clearance at the smaller diameter end 109 of the rotor assembly 107, remains unchanged (h3 being equal in magnitude to h1 in FIG. 7), whereas gap height h4 at the center of circumferential groove 110 in FIG. 8 has now significantly reduced in magnitude (as compared with h2 in FIG. 7). Consequently, liquid traveling along the annular fluid volume between h3 and h4 in FIG. 8 is throttled to a far more marked extent as compared to it travel between positions h1 and h2 in FIG. 7. As a result, the liquid traveling along the fluid heat generating region in this second embodiment of the invention is subject to this additional throttling effect during its approach toward circumferential groove 110 as compared to the first embodiment of the present invention.

DETAILED DESCRIPTION OF THE THIRD EMBODIMENT OF THE INVENTION

As the third embodiment of the present invention is a hybrid of the first and second embodiments of the invention, as such, only those features that differ will be here now described.

Figure 9:
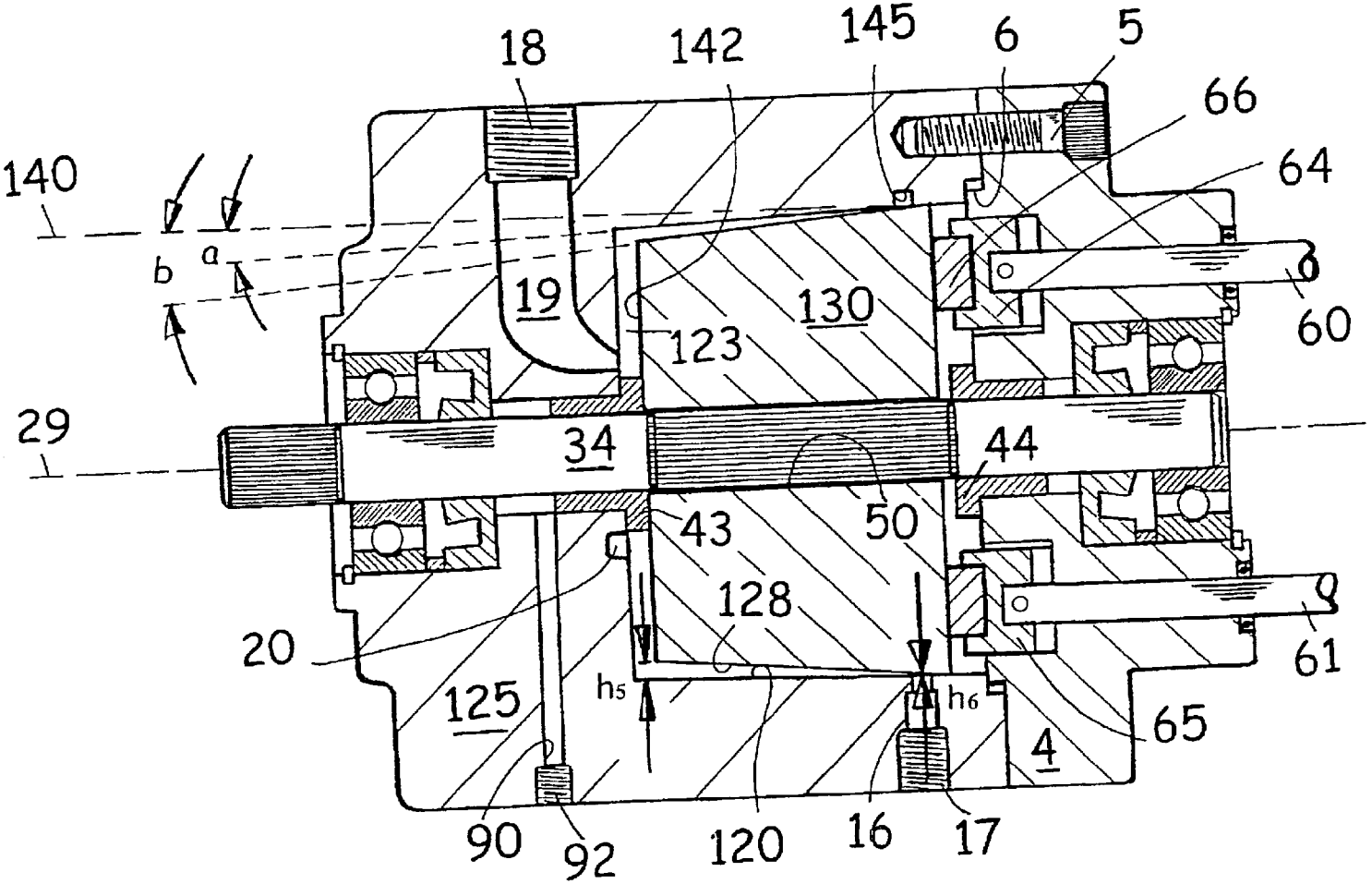
FIG. 9 is a longitudinal sectional view of a device in according to the third embodiment of the present invention.

In FIG. 9, the inner surface 120 for the main chamber 123 in housing element 125 as well as outer surface 128 of the rotor assembly 130 remain conical as was the case in the first embodiment of the invention. However, here first and second boundary defining surfaces are angularly inclined with respect to the rotating axis by different amounts. Note therefore that the inner surface 120 in housing element 125 is angularly inclined by an angle depicted by "a" from the horizontal axis shown as 140 whereas the outer surface 128 of the rotor assembly 130 is angularly inclined by an angle depicted by "b" from the horizontal axis shown as 140. Horizontal axis 140 is shown lying parallel and offset with respect to rotation axis 29 of drive shaft 34.

With this hybrid, liquid travelling along the annular fluid volume between h5, depicting the annular clearance at the smaller diameter end 142 of the rotor assembly 130, and h6, the gap height at the center of circumferential groove 145, although throttled in similar fashion as for the second embodiment described earlier, is throttled to a far more marked extent as a result of both surfaces 120, 128 being angularly inclined with respect to the horizontal.

Although the embodiments described above rely on a circumferential groove for the collection of the heated liquid or gas at the exit region, the device could be adapted to include axial end porting on the larger diameter end of the rotor assembly. Then the fluid outlet would be served by a duct positioned in the housing axially adjacent the rotor assembly.

Through the precise control in the size of the radial gap height between the fluid boundary defining surfaces of the revolving element and the static element, the device is able to respond much faster to changed conditions with far more precision and rapidity than prior solutions relying on a fixed clearance between the rotor and housing. Consequently there is far better control of the heat being generated by the device.

Although all the embodiments here described are best served by having a rotor assembly that can be bodily shifted axially along the longitudinal axis of the drive shaft either towards or away from the static inner working surface of the housing to fine tune the desired for characteristic desired from the device, it is not intended to limit the present invention in this way. For instance, with certain applications to which the apparatus as described may be advantageously applied, the initial radial clearance selected between rotor and housing may be satisfactory and suit all the conditions encountered in service. In such situations, it may be quite acceptable that the rotor remain fixed to the drive shaft without having any inherent ability or freedom to move relative to the drive shaft, although, preferably, ability for such movement would be advisable, at least for the reason to take up slack due to wear or the bedding in of the running components.

Additional heating of the fluid can be created in the device once there is a notable pressure difference occurring between inlet and exit. For example, when mains pressure is used, or an internal impeller is used to create additional pressure head, heat is automatically released once the fluid emerges in the lower pressure zone. This mechanical heating may serve to improve the effectiveness of the device. With the second and third embodiments of the invention, the throttling effect on the fluid by the converging geometry of the annular clearance volume may well be used to good effect to further promote such additional heating of the fluid.

Furthermore, although there will be turbulence in the liquid passing through between the fluid boundary defining surfaces, subject to the shearing action in heating up the liquid, additional friction can be introduced by substituting the essential smooth bore boundary surfaces with roughened surfaces, for example, by shot penning, the outer surface of the rotor assembly. The thus created surface irregularities should ideally not be so pronounced however, to act as contamination traps.

In order that less reliance is placed on mains water pressure or operation with an adequate head or potential of fluid above the device, the axially expanding annular clearance along the substantive length of the rotor assembly as shown in the first embodiment, together with the helical flow pattern generated by the spinning rotor surface of the rotor is used to generate a negative pressure condition helping to propel liquid through the device. Any tendency for radial motion of the liquid in the clearance due to centrifugal force generated by the rotating rotor is vectored axially by the angularly inclined surfaces in a direction up the incline, in other words from the smaller diameter end of the rotor towards the larger diameter end of the rotor. It is envisioned that by careful selection in the critical radial gap height for the annular clearance, a condition tending towards cavitation in the liquid, due to forces attempting molecular separation in the liquid film between the surfaces, might occur without requiring the surface irregularities taught by Griggs.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

I claim:

1. A fluid heating apparatus comprising a housing having a main chamber;

a central member within said main chamber and movable relative to said housing about an axis of rotation;

said central member comprising an outer surface confronting an inner surface of said main chamber and defining an annular fluid volume therebetween;

a fluid inlet communicating with said annular fluid volume and situated nearer one end of said main chamber and a fluid outlet communicating with said annular fluid volume and situated nearer an opposite end of said main chamber, said fluid inlet and said fluid outlet each opening exteriorly of said housing, wherein at least one of said inner and outer surfaces is angularly inclined relative to said axis of rotation.

2. A fluid heating apparatus according to claim 1 wherein said central member is a rotor driven in rotation about said axis of rotation, and said inner surface being stationary.

3. A fluid heating apparatus according to claim 2 further comprising a drive shaft rotatably supported in said housing and having a longitudinal axis of rotation; said rotor being driven by said drive shaft and where at least one of said inner and outer surfaces can be axially displaced relative to the position of said drive shaft to change said annular fluid volume.

4. The fluid heating apparatus according to claim 3 wherein said one of said first and second cylindrical surfaces is rotating at equal speed to said drive shaft.

5. The fluid heating apparatus according to claim 2 wherein both said inner and outer surfaces are inclined relative to said axis of rotation.

6. The fluid heating apparatus according to claim 2 wherein both said inner and outer surfaces are inclined relative to said axis of rotation by the same amount.

7. The fluid heating apparatus according to claim 2 wherein said inner and outer surfaces are inclined relative to said axis of rotation by a different amount.

8. A fluid heating apparatus according to claim 1 wherein said inner and outer surfaces are retractable from one another in an axial direction to increase said annular fluid volume.

9. A fluid heating apparatus according to claim 1 wherein said inner and outer surfaces are movable towards one another in an axial direction to decrease said annular fluid volume.

10. The fluid heating apparatus according to claim 1 wherein fluid entering said annular fluid volume is subjected to increased turbulence and shearing when said inner and outer surfaces move closer towards one another and decreased turbulence and shearing when said inner and outer surfaces move further from one another.

11. A fluid heating apparatus comprising a housing having a main chamber and a fluid inlet and a fluid outlet in fluid communication with said main chamber, said fluid inlet and said fluid outlet each opening exteriorly of said housing;

a rotor assembly disposed centrally in said main chamber, said fluid inlet being nearer a distal end of said rotor assembly and said fluid outlet being nearer the proximate end of said rotor assembly;

a drive shaft having a longitudinal axis of rotation rotatably supported in said housing and drivingly connected to said rotor assembly for imparting mechanical energy to said rotor assembly;

and first and second opposing fluid boundary defining surfaces radially spaced apart from one another along at least a majority of length of said rotor assembly to form a fluid heat generating region and wherein at least one of said fluid boundary defining surfaces is angularly inclined with respect to said longitudinal axis.

12. A fluid heating apparatus according to claim 11 wherein one of said fluid boundary defining surfaces can be axially displaced relative to the position of said drive shaft to change the volume of said fluid heat generating region.

13. A fluid heating apparatus according to claim 11 wherein said first and second opposing fluid boundary defining surfaces are retractable from one another in an axial direction for an increase in the radial distance there inbetween.

14. A fluid heating apparatus according to claim 11 wherein said first and second opposing fluid boundary defining surfaces are arranged to move towards one another in an axial direction for a decrease in the radial distance there inbetween.

15. A fluid heating apparatus according to claim 11 wherein said rotor assembly can be axially displaced relative to the position of said drive shaft to change the volume of said fluid heat generating region.

16. The fluid heating apparatus according to claim 11 wherein the fluid entering said fluid heating region is subjected to increased turbulence and shearing when said first and second opposing fluid boundary defining surfaces move closer towards one another and decreased turbulence and shearing when said first and second opposing fluid boundary defining surfaces move further from one another.

17. The fluid heating apparatus according to claim 16 wherein at least one of said boundary defining surfaces is rotating at equal speed to said drive shaft.

18. The fluid heating apparatus according to claim 16 wherein at least one of said boundary defining surfaces is being rotated by said drive shaft.

19. The fluid heating apparatus according to claim 18 wherein both said first and second opposing fluid boundary defining surfaces are inclined relative to said longitudinal axis.

20. The fluid heating apparatus according to claim 19 wherein both said first and second opposing fluid boundary defining surfaces are inclined relative to said longitudinal axis by the same amount.

21. The fluid heating apparatus according to claim 19 wherein said first and second opposing fluid boundary defining surfaces are inclined relative to said longitudinal axis by a different amount.

22. The fluid heating apparatus according to claim 16 wherein said rotor assembly includes an impeller disposed at the smaller of its two end faces, said impeller rotating at equal speed to said drive shaft to propel fluid radially towards said fluid heating region.

23. A fluid heating apparatus according to claim 11 wherein said rotor assembly is axially displaceable relative to said drive shaft such that on the one hand said first and second opposing fluid boundary defining surfaces may be moved closer towards one another, whereas on the other hand said first and second opposing fluid boundary defining surfaces may be moved further part from one another.

24. The fluid heating apparatus according to claim 23 wherein the fluid entering said fluid heating region is subjected to increased turbulence and shearing when said first and second opposing fluid boundary defining surfaces move closer towards one another and decreased turbulence and shearing when said first and second opposing fluid boundary defining surfaces move further from one another.

25. A fluid heating apparatus comprising a housing;

a main chamber in said housing and a rotor assembly disposed in said main chamber, said rotor assembly and said main chamber defining an inlet region an exhaust region and a fluid heat generating region;

a drive shaft having a longitudinal axis of rotation rotatably supported in said housing and drivingly connected to said rotor assembly for imparting mechanical energy to said rotor assembly;

a fluid inlet provided in said housing and in fluid communication with said inlet region;

a fluid outlet provided in said housing and in fluid communication with said exhaust region;

said fluid inlet and said fluid outlet each opening exteriorly of said housing, said apparatus further comprising first and second opposing fluid boundary defining surfaces radially spaced apart from one another along at least a majority of length of said rotor assembly to form said fluid heat generating region and a unidirectional pathway for fluid upon entering said inlet region to reach said exhaust region, wherein at least one of said fluid boundary defining surfaces is angularly inclined with respect to said longitudinal axis.

26. A fluid heating apparatus according to claim 25 wherein one of said fluid boundary defining surfaces can be axially displaced relative to the position of said drive shaft to change the volume of said fluid heat generating region.

27. A fluid heating apparatus according to claim 25 wherein said first and second opposing fluid boundary defining surfaces are retractable from one another in an axial direction for an increase in the radial distance there inbetween.

28. A fluid heating apparatus according to claim 25 wherein said first and second opposing fluid boundary defining surfaces are moveable towards one another in an axial direction for a decrease in the radial distance there inbetween.

29. A fluid heating apparatus according to claim 25 wherein said rotor assembly can be axially displaced relative to the position of said drive shaft to change the volume of said fluid heat generating region.

30. The fluid heating apparatus according to claim 25 wherein the fluid entering said fluid heating region is subjected to increased turbulence and shearing when said first and second opposing fluid boundary defining surfaces move closer towards one another and decreased turbulence and shearing when said first and second opposing fluid boundary defining surfaces move further apart from one another.

31. The fluid heating apparatus according to claim 30 wherein at least one of said boundary defining surfaces is rotating at equal speed to said drive shaft.

32. The fluid heating apparatus according to claim 30 wherein at least one of said boundary defining surfaces is being rotated by said drive shaft.

33. The fluid heating apparatus according to claim 32 wherein both said first and second opposing fluid boundary defining surfaces are inclined relative to said longitudinal axis.

34. The fluid heating apparatus according to claim 33 wherein both said first and second opposing fluid boundary defining surfaces are inclined relative to said longitudinal axis by the same amount.

35. The fluid heating apparatus according to claim 33 wherein said first and second opposing fluid boundary defining surfaces are inclined relative to said longitudinal axis by a different amount.

36. The fluid heating apparatus according to claim 30 wherein said housing includes a port and where said inlet is connected by said port to said fluid entry region.

37. The fluid heating apparatus according to claim 36 wherein said housing includes a fluid capturing groove, said capturing groove circumferentially surrounding said fluid heat generating region and positioned nearer that distal end of said rotor assembly lying furtherest from said inlet region, said exhaust region connected by said fluid capturing groove to said fluid exit.

38. The fluid heating apparatus according to claim 30 wherein said inlet region increases in volume as said rotor assembly is axially displaced in the direction for causing said first and second opposing fluid boundary defining surfaces to move further apart from one another.

39. The fluid heating apparatus according to claim 38 wherein said rotor assembly includes an impeller disposed at the smaller of its two end faces, said impeller rotating at equal speed to said drive shaft in said inlet region to propel fluid radially towards said fluid heating region.

40. The fluid heating apparatus according to claim 39 wherein the fluid entering said fluid heating region is subjected to increased turbulence and shearing when said first and second opposing fluid boundary defining surfaces move closer towards one another and decreased turbulence and shearing when said first and second opposing fluid boundary defining surfaces move further from one another.

41. A fluid heating apparatus according to claim 25 wherein said rotor assembly is axially displaceable relative to said drive shaft such that on the one hand said first and second opposing fluid boundary defining surfaces may be moved closer towards one another, whereas on the other hand said first and second opposing fluid boundary defining surfaces may be moved further apart from one another.

42. The fluid heating apparatus according to claim 41 wherein the fluid entering said fluid heating region is subjected to increased turbulence and shearing when said first and second opposing fluid boundary defining surfaces move closer towards one another and decreased turbulence and shearing when said first and second opposing fluid boundary defining surfaces move further apart from one another.

* * * * *